United States Patent [19]

Ekbom

[11] Patent Number: 5,069,138

[45] Date of Patent: Dec. 3, 1991

[54] ARMOR-PIERCING PROJECTILE WITH SPICULATING CORE

[76] Inventor: Lars Ekbom, Granitvägen 16, S-186 35 Vallentuna, Sweden

[21] Appl. No.: 459,489

[22] Filed: Jan. 2, 1990

[30] Foreign Application Priority Data

Jan. 2, 1989 [SE] Sweden ..... 8900012

[51] Int. Cl.[5] ..... F42B 12/06

[52] U.S. Cl. ..... 102/518

[58] Field of Search ..... 102/517-519

[56] References Cited

U.S. PATENT DOCUMENTS

| | | | |
|---|---|---|---|
| 577,183 | 2/1897 | Borchardt | 102/517 |
| 644,361 | 2/1900 | Luciani | 102/518 |
| 2,393,648 | 1/1946 | Martin | 102/517 |
| 3,203,349 | 8/1965 | Schonberg | 102/517 |
| 3,302,570 | 2/1967 | Marquardt | 102/52 |
| 4,123,975 | 11/1978 | Mohaupt | 102/92.4 |
| 4,256,039 | 3/1981 | Gilman | 102/517 |
| 4,616,569 | 10/1986 | Montier et al. | 102/517 |
| 4,671,181 | 6/1987 | Romer et al. | 102/518 |
| 4,869,175 | 9/1989 | McDougal | 102/518 |

FOREIGN PATENT DOCUMENTS

| | | | |
|---|---|---|---|
| 0279440 | 2/1988 | European Pat. Off. . | |
| 413203 | 4/1980 | Sweden . | |
| 5960 | of 1885 | United Kingdom | 102/519 |
| 16089 | of 1900 | United Kingdom | 102/519 |
| 1514908 | 6/1978 | United Kingdom . | |

*Primary Examiner*—Harold J. Tudor

*Attorney, Agent, or Firm*—Pollock, Vande Sande & Priddy

[57] ABSTRACT

The device is employed in connection with armor-piercing projectiles so as to improve penetration into armor. The projectile is in the form of a substantially rotation symmetrical projectile body containing a core and surrounding projectile body wherein the core is of a material which, under the penetration conditions prevailing for armor penetration, has a hardness which is greater than in the surrounding projectile body. In that a spiculated nose is formed, the mass forces on displacement of the armor material ahead of the projectile will be reduced and penentration will be increased.

7 Claims, 2 Drawing Sheets

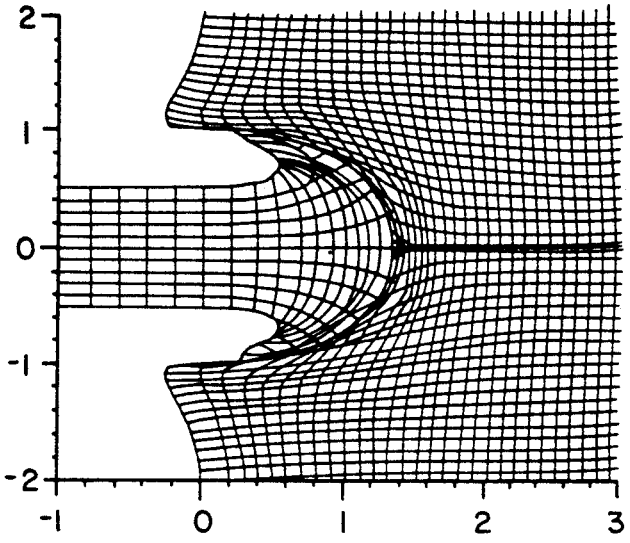
FIG. 1
FIG. 4
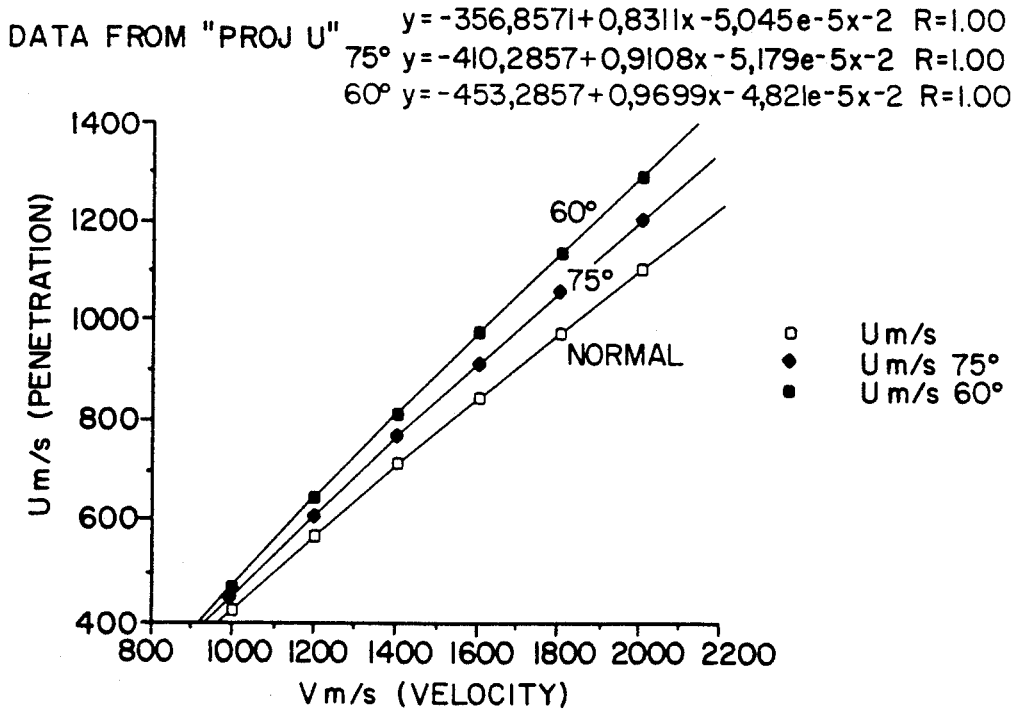

ARMOR-PIERCING PROJECTILE WITH SPICULATING CORE

TECHNICAL FIELD

The present invention relates to armour-piercing projectiles, and in particular to arrangements for improving the penetration of armour.

BACKGROUND ART

Modern armour-piercing projectiles are based on the principle of penetrating the armour under attack with high kinetic energy (KE) concentrated at a small area of the armour. The projectiles are subcalibre and designed as arrows with guiding fins. They have a length/calibre ratio which is 10:1 or higher. They are fired from guns with a calibre of at least 40 mm with muzzle velocities of 1500 m/s or more.

To achieve high KE the material in the projectile must be of high density. Normally, use is made of a heavy metal, e.g. a tungsten alloy containing a few percent of nickel and iron. Typically, the alloy consists of 92% tungsten, 5% nickel and 3% iron and has a density of 17.5 $Mg/m^3$. The projectile material is produced from powder which is formed into rods and smelt-phase sintered at approx. 1470° C. The production process is normally terminated by cold working and heat treating. Other projectile materials are impoverished uranium alloyed with titanium, but steel is also employed.

It is previously known in this art that armour-piercing projectiles are designed with cores of other material. For example, according to U.S. Pat. No. 4,616,569 of Oct. 14, 1986, an armour-piercing projectile is reinforced with a body extending throughout the entire projectile center and being of extreme strength and rigidity. The inner body, which at least in part consists of wires, is secured to the projectile by shrinking and serves to hold together the projectile on impact against the armour. According to U.S. Pat. No. 4,256,039 of Mar. 17, 1981, an axially extending core is provided with a wrapped foil of metallic glass (amorphous metal) of high hardness. By such means, there will be obtained a projectile with an outer portion of high strength. According to the present patent, the projectile is designed with a core of a different type, whose function is to reduce the resistance against penetration into the armour material.

On penetration of the projectile into steel armour of normal type, the tip of the projectile is gradually deformed at the same time as the material in the armour is displaced and a hole is formed, see FIG. 1. The penetration velocity into the armour will depend upon the KE of the projectile which is counterbalanced by the energy which is required to displace the armour material. If the point of contact between projectile and armour is regarded as stationary, the penetration may be described such that projectile and armour flow in towards the point of contact. From this, a pressure balance according to Bernoulli will be obtained:

$$\tfrac{1}{2}p_{Pa}U^2+R\sigma_{pa}=\tfrac{1}{2}P_{p2}(V-U)+\sigma_{pr}$$

wherein U is the velocity of the point of contact, V is the projectile velocity, $p_{Pr}$ is the density of the projectile, Pr, and $p_{Pa}$ is the density of the armour, Pa and $\sigma$ is the yield stress of each respective material. R is a geometric form factor which may be set at approximately = 3.5.

The higher the velocity of the projectile, the higher the pressure at the contact surface between projectile and armour will be, and the higher the velocity will be at which the projectile and armour material are displaced out laterally. The radial material flow results in a penetration channel being formed in the armour. The higher the velocity of the radial material flow, the greater the diameter of the thus formed channel will be. At moderate projectile velocity (1500 m/s) the diameter of the thus formed hole will itself be itself moderate or about twice the diameter of the projectile. As the velocity increases, the channel becomes progressively wider. At velocities in excess of 2000 m/s, the KE which is consumed for the radial mass transport will be wholly predominant over the energy required to overcome the mechanical strength of the steel armour plating.

An increase in the mechanical strength of a projectile has only a limited effect on penetration. Moreover, the severe deformation of the projectile nose during penetration leads to such immense heat generation that the material locally melts and loses all mechanical strength. For an armour piercing projectile, substantial toughness is also required in order to be capable of penetrating several layers of modern armour plating. Normally, an increase in mechanical strength leads to a reduction in toughness.

At projectile velocities of less than 1000 m/s, hard projectiles (cemented carbides) are utilized, which retain their shape on penetration. For such projectiles, the material flow ahead of the penetrating projectile is influenced by the nose shape. A more acute—or spiculated—shape gives within certain limits lower resistance against penetration and thus deeper penetration. This is because the radial armour material displacement ahead of the penetrating projectile takes place at lower acceleration and lower velocity, whereby the resistance against penetration on account of the mass forces is reduced. In other words, it is possible to influence the penetration depth by the shape of the projectile nose. The original shape of the nose is obviously of no significance to armour-piercing projectiles which, at high velocity, are gradually deformed during armour penetration.

The possibilities of increasing penetration for armour-piercing projectiles are limited to increasing projectile velocity and the length/diameter ratio. However, such measures impose higher demands on the mechanical strength and toughness of the material in the projectile, something that is problematical to achieve.

A projectile shape which leads to lowered resistance to penetration by reduced mass forces is of importance, in particular since the trend in military technology is to raise projectile velocities to about 2000 m/s. At a higher velocity, the relative influence of the mass forces increases.

SUMMARY OF THE INVENTION

The object of the present invention is to realize, by choosing different materials in the centre of the projectile and its periphery, such deformation of the projectile that a spiculated nose is formed, whereby penetration into armour is facilitated.

The principle for the shape of the projectile (see FIG. 2) requires the insertion, in the center of the largely cylindrical projectile body (1), normally manufactured of heavy metal, of a core (2) of a material which, under those conditions prevailing on projectile penetration, has a high compressive strength. As a consequence of this design, the harder center is deformed to a lesser degree than the softer metal which surrounds the core. A spiculated nose is formed which facilitates penetration of the projectile into the armour in that the mass forces are reduced. Acceleration and speed of the radial material flow decrease.

For a rigid projectile, it is possible to calculate the influence of the nose shape on the projectile velocity as disclosed by Åke Persson in Proc. 2nd International Symposium for Ballistics, 1976. A corresponding calculation makes it possible to gain an impression, using a modified version of Bernoulli's equation, of how the penetration velocity is influenced by the nose shape of the projectile. By introducing a constant c into the expression for the mass forces in the armour, these can be modified to values corresponding to an imaginary, more spiculated projectile nose.

$$\tfrac{1}{2}c\rho_{Pa}U^2+R\sigma_{Pa}=\tfrac{1}{2}\rho_{Pr}(V-U)^2+\sigma_{Pr}$$

In the normal case, c=1, which, in this non-physical calculation, may be said to correspond to a radial velocity of the displaced target material which is equal to the penetration velocity U (FIG. 3). The contemplated nose cone angle of the projectile will then be 90°. For a more spiculated projectile with a contemplated nose cone angle of 60°, the radial velocity of the target material will be but half of the penetration velocity U. A calculation of the penetration velocity for both of these cases, as well as for a nose cone angle of 75° as a function of the projectile velocity V is apparent from FIG. 4.

In order that a core in the center of the projectile be capable of contributing to the formation of a nose tip during penetration, the following requirements must be placed on the core:

The major share of the KE must be transmitted by the projectile mass (heavy metal, uranium alloy). The toughness of the projectile must not be appreciably affected by the harder core. For these reasons, the core must constitute a limited portion of the material volume. Consequently, the core diameter/projectile diameter ratio should be less than ¼.

The material in the core must have a substantial compressive strength at those conditions which prevail in the projectile nose during penetration. This implies that the mechanical strength must be high also at temperatures in excess of 1000° C. One example of a metal possessing such properties and, at the same time, high density, is tungsten. Another example being tungsten alloys. Among the cermets, i.e. metal-ceramic composites, cemented carbide (tungsten carbide-cobalt) is of particular interest. Certain high-strength ceramics such as aluminum oxide carborundum, and titanium boride may also be employed.

The design of the core must be appropriate to ensure its proper function as a spiculator. During penetration, extreme pressure on the core arises. This pressure causes the core to be pressed rearwards in the surrounding projectile material. To prevent this, the core must be supported by the rear end of the projectile, FIG. 2, and/or there must be a good adhesion between the core and the projectile material.

BRIEF DESCRIPTION OF THE ACCOMPANYING DRAWINGS

FIG. 1 shows deformation of projectile and armour on penetration of a heavy metal projectile into steel armour plating.

FIG. 4 shows the calculated penetration velocity at different conceivable nose tip angles.

DESCRIPTION OF PREFERRED EMBODIMENT

Figure 2:
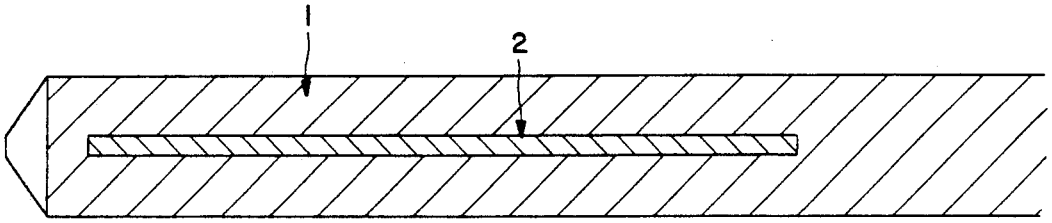
FIG. 2 shows the design of a projectile with a core according to the present invention.
Figure 3:
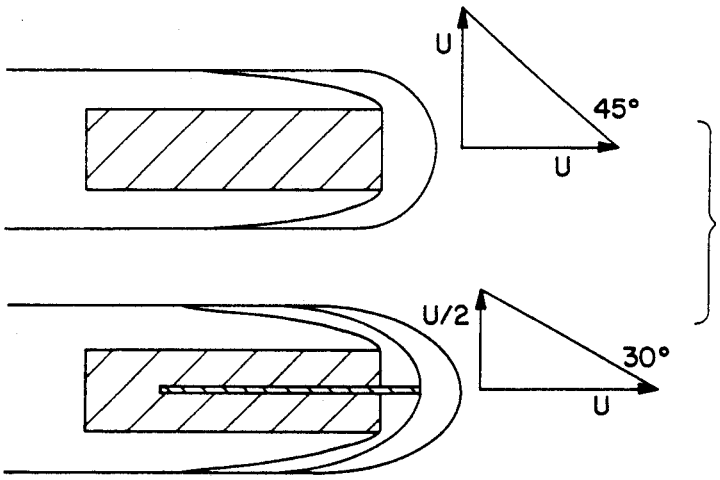
FIG. 3 shows the difference in radial velocity of the armour material ahead of various conceivable nose tip angles.

The subcalibre armour-piercing projectile is designed in a manner which is apparent from FIG. 2. In manufacturing of the projectile body, use is normally made of a sintered tungsten alloy, a so-called heavy metal. Manufacturing is carried out by liquid phase sintering of tungsten-nickel-iron powder.

According to the preferred embodiment of the present invention, an elongate slender core (2) is inserted, the core being of a diameter which is less than ¼ of the outside diameter of the projectile (1) preferably between 5 and 25 percent of the largest diameter of the projectile and being of a material which has high compressive strength at temperatures in excess of 1000° C. and being, under the penetration conditions prevailing, at least twice as hard as the projectile material, for example cemented carbide. The length of the core is between 400 and 4000 percent of the largest diameter of the projectile. The term penetration conditions is here taken to mean a powerful compression deformation, high deformation velocity ($\dot{\epsilon}>10^4$) and temperatures above 1000° C.

The core (2) must be firmly anchored in the projectile body (1), which may be achieved in that the rear portion of the projectile has no core, or that the adhesion of the core to the projectile body proper is firm.

In order to achieve firm adhesion between core and projectile, the core may be inserted directly into the pressed green body or into a drilled-out recess in the presintered or sintered projectile blank. If a uranium alloy is employed, the core may correspondingly be inserted into a drilled-out recess in the projectile blank. After sealing of the recess, hot isostatic pressing, for example, may be employed as a final stage to ensure good adhesion between core and projectile material.

Experiments carried out on a model scale using heavy metal projectiles fitted with a core of cemented carbide demonstrate that the principle of spiculation functions and that an increased penetration of steel armour plating is obtained.

What we claim and desire to secure by Letters Patent is:

1. An armour-piercing elongated arrow style projectile in the form of a substantially rotation symmetrical projectile body including a core centrally disposed and aligned in the longitudinal direction of the projectile, which comprises a core and surrounding projectile body wherein the core is of a material which, under the penetration conditions prevailing for armour penetration, has a hardness which is greater than twice the hardness of the material in the surrounding projectile body; that the entire length of the core is of a diameter which is between 5 and 25 percent of the largest diameter of the symmetrical projectile body and a length which is between 400 and 4000% of the largest diameter of the projectile body; and that the core is fixedly secured in the surrounding projectile body.

2. The projectile as claimed in claim 1, characterized in that the core consists essentially of a member selected from the group of tungsten and alloys thereof.

3. The projectile as claims in claim 1, characterized in that the core consists essentially of a cermet.

4. The projectile as claimed in claim 1, characterized in that the core consists essentially of a ceramic.

5. The projectile as claimed in claim 1, characterized in that the core is sintered to the surrounding projectile body.

6. The projectile of claim 1 wherein the core consists essentially of cemented carbide.

7. The projectile of claim 4 wherein said ceramic is selected from the group consisting of aluminium oxide, carborundum and titanium boride.

* * * * *